US007347206B2

(12) United States Patent
Pedemonte

(10) Patent No.: US 7,347,206 B2
(45) Date of Patent: Mar. 25, 2008

(54) CONTROL GROUP OF A SECOND-STAGE REGULATOR FOR SCUBA DIVERS

(75) Inventor: Stefano Pedemonte, Ceranesi (IT)

(73) Assignee: Cressi Sub S.p.A., Genoa (IT)

( * ) Notice: Subject to any disclaimer, the term of this patent is extended or adjusted under 35 U.S.C. 154(b) by 0 days.

(21) Appl. No.: 10/899,203

(22) Filed: Jul. 26, 2004

(65) Prior Publication Data

US 2005/0016538 A1 Jan. 27, 2005

(30) Foreign Application Priority Data

Jul. 25, 2003 (IT) ..... FI20030070 U

(51) Int. Cl.
*A61M 16/00* (2006.01)
*B63C 11/22* (2006.01)

(52) U.S. Cl. ..... 128/204.26; 128/201.27; 128/201.28; 128/205.12; 137/494; 137/510; 251/359; 251/360

(58) Field of Classification Search ..... 128/200.29, 128/201.26, 201.27, 206.29, 204.26, 204.27, 128/201.28, 205.12; 137/494, 510, 512.4, 137/885, 512; 251/359, 360
See application file for complete search history.

(56) References Cited

U.S. PATENT DOCUMENTS

| | | | | |
|---|---|---|---|---|
| 3,570,808 | A * | 3/1971 | Wrenn | 251/149.6 |
| 4,219,017 | A * | 8/1980 | Shamlian et al. | 128/204.26 |
| 5,190,030 | A * | 3/1993 | Semeia | 128/204.26 |
| 5,259,375 | A * | 11/1993 | Schuler | 128/205.24 |
| 6,718,977 | B1 * | 4/2004 | Matsuoka | 128/204.26 |

* cited by examiner

*Primary Examiner*—Justine R. Yu
*Assistant Examiner*—Shumaya Ali
(74) *Attorney, Agent, or Firm*—Pollack, P.C.

(57) ABSTRACT

A group for controlling a second-stage regulator for scuba divers. The regulator comprises a regulator body with an inlet conduit for connection to a first-stage regulator which supplies a breathable gaseous mixture at a constant pressure and an outlet conduit for connection to a mouthpiece of the user. The group comprises a first bushing defining an intermediate chamber with a bottom wall wherein a central hole is formed, a poppet loosely engaged within the hole, the end of the poppet being connected to lever means, a second bushing engaged in the first bushing and defining an inlet chamber and a third bushing engaged in the second bushing and defining a regulator seat at one of its ends. The head of the poppet engages tightly in the seat and an elastic member is provided coaxial to the poppet in the intermediate chamber for maintaining the head against the regulator seat.

9 Claims, 2 Drawing Sheets

CONTROL GROUP OF A SECOND-STAGE REGULATOR FOR SCUBA DIVERS

FIELD OF THE INVENTION

The present invention relates generally to equipment for use in limited oxygen environments and, more particularly, to a group for controlling a second-stage regulator for scuba divers.

BACKGROUND ART OF THE INVENTION

In scuba diving, for instance, a supply of air, or of an air-oxygen mixture, is typically fed to a mouthpiece of the scuba diver from a high-pressure tank. Enroute to the diver, the air passes via a first-stage pressure-reducing regulator to a second-stage regulator which, in turn, supplies the mixture to the mouthpiece, when pressure within the regulator is diminished upon the diver's inhalation.

Second-stage regulators of the known type have an inlet chamber connected to the outlet of the first-stage regulator, and an outlet chamber connected to the mouthpiece of the user and separated from the outside environment by an elastically deformable diaphragm which blocks an opening formed in the regulator body. The diaphragm is connected via a lever to a poppet which closes off the passage between the two chambers. The pressure inside the inlet chamber is maintained constant at approximately ten bars as the pressure in the tank varies thanks to appropriate calibration of the first-stage regulator. When the user does not breathe, his or her lungs, the mouthpiece, the outlet chamber and the outside environment are at the same pressure. When the user inhales, a vacuum is created inside the outlet chamber and the diaphragm bends towards the interior of said chamber, moving the poppet, which normally closes the passage between the inlet chamber and the outlet chamber, to an opening position.

The opening of the passage between the inlet chamber and outlet chamber creates an overpressure in the outlet chamber, so that the diaphragm returns into the rest position, moving the lever and returning the poppet into the starting position wherein the passage between the inlet chamber and the outlet chamber is closed once again.

In second-stage regulators of the known type the regulator seat, on which the seal of the head of the poppet rests, is housed inside the inlet conduit of the regulator which is integral to the body of the same regulator. This configuration complicates the regulator calibration operations required during assembly to compensate the unavaoidable dimensional deviations, within the design tolerances, of the various components from the optimum values. Moreover minor maintenance work on the regulator, which could be performed without problems even by the user, instead requires intervention by a specialised technician in that the device has to be recalibrated each time.

OBJECTS AND SUMMARY OF THE INVENTION

Accordingly, it is an object of the present invention to provide a group for controlling a second-stage regulator for scuba divers with a structure simplfies regulator calibration during assembly and which enables simple maintenance work to be performed by the user without necessity of disassembling the control mechanism.

This object is achieved with the group for controlling a second-stage regulator for scuba diver according to the present invention whose feature consists in that it comprises a first bushing defining an intermediate chamber with a bottom wall wherein a central hole is formed wherein a poppet engages loosely, the end of the poppet being connected to lever means, and a second bushing engaged in the first bushing and defining a regulator seat at one of its ends, on which the head of the poppet engages tightly, elastic means being provided coaxial to the poppet in the intermediate chamber for maintaining the head against the regulator seat, the whole group being removably engaged in the inlet conduit.

BRIEF DESCRIPTION OF THE DRAWINGS

A specific, illustrative control group of a second-stage regulator for scuba divers, in accordance with the present invention, is described below with reference to the accompanying drawings, in which.

The same numerals are used throughout the drawing figures to designate similar elements. Still other objects and advantages of the present invention will become apparent from the following description of the preferred embodiments.

DETAILED DESCRIPTION OF THE PREFERRED EMBODIMENTS

Figure 1:
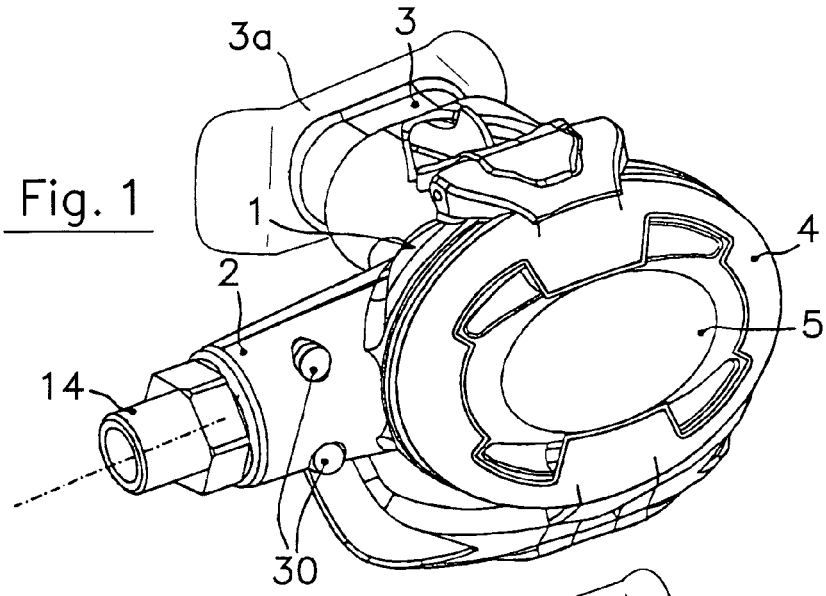
FIG. 1 is a perspective view of a second-stage regulator for scuba divers having a control groups according to one aspect of the present invention.

Referring now to the drawings and, more particularly, to FIGS. 1-4, there is shown generally a specific, illustrative control group of a second stage regulator for scuba divers, in accordance with the present invention. According to one embodiment, illustrated generally in FIG. 1, the regulator includes a body 1 having an inlet conduit 2 and an outlet conduit 3. The inlet conduit is used for connecting the second stage regulator to a first-stage regulator which supplies a breathable gaseous mixture at a relatively constant pressure, while the outlet conduit is held in the mouth by the scuba diver via a mouthpiece 3*a*.

Figure 2:
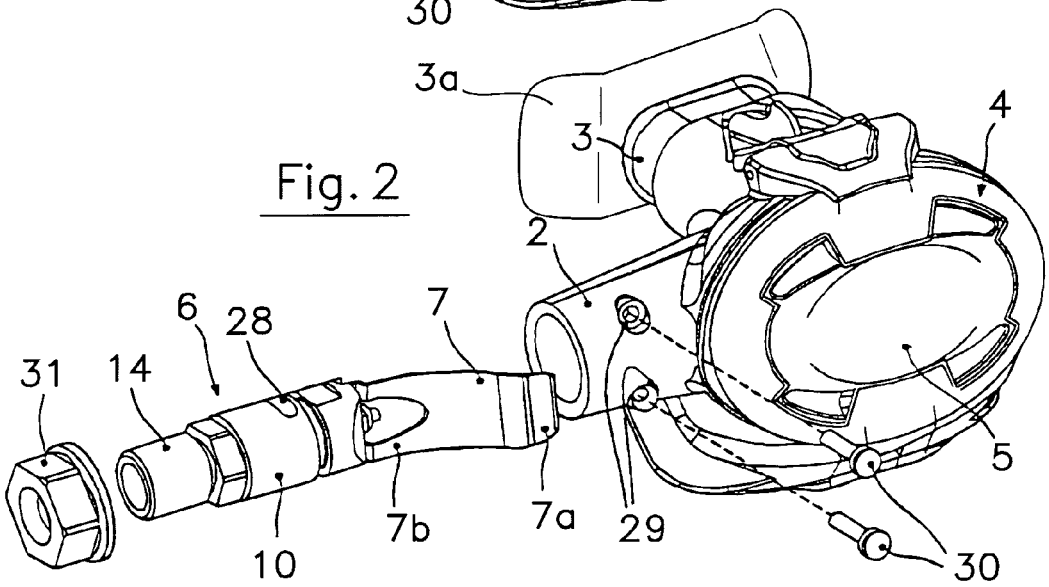
FIG. 2 is a partially exploded perspective view of the regulator shown in FIG. 1.
Figure 3:
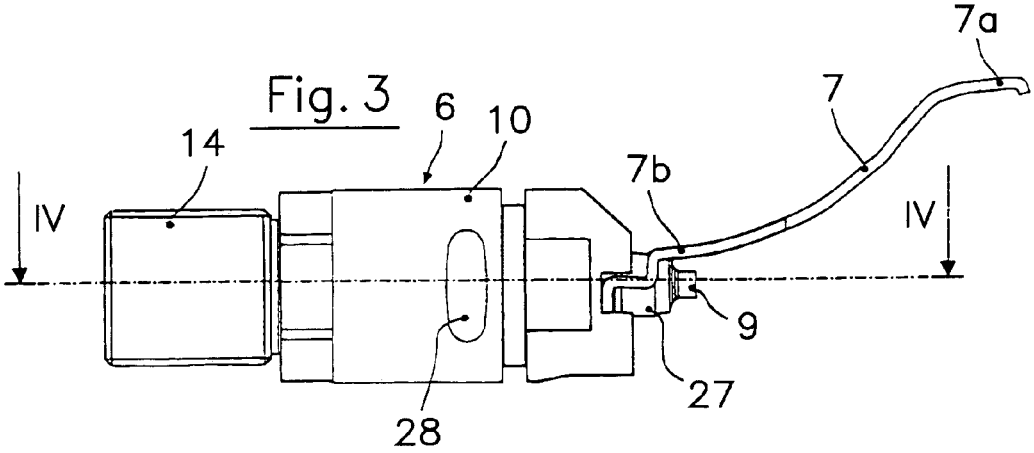
FIG. 3 is a plan view of the control group shown in FIG. 1.
Figure 4:
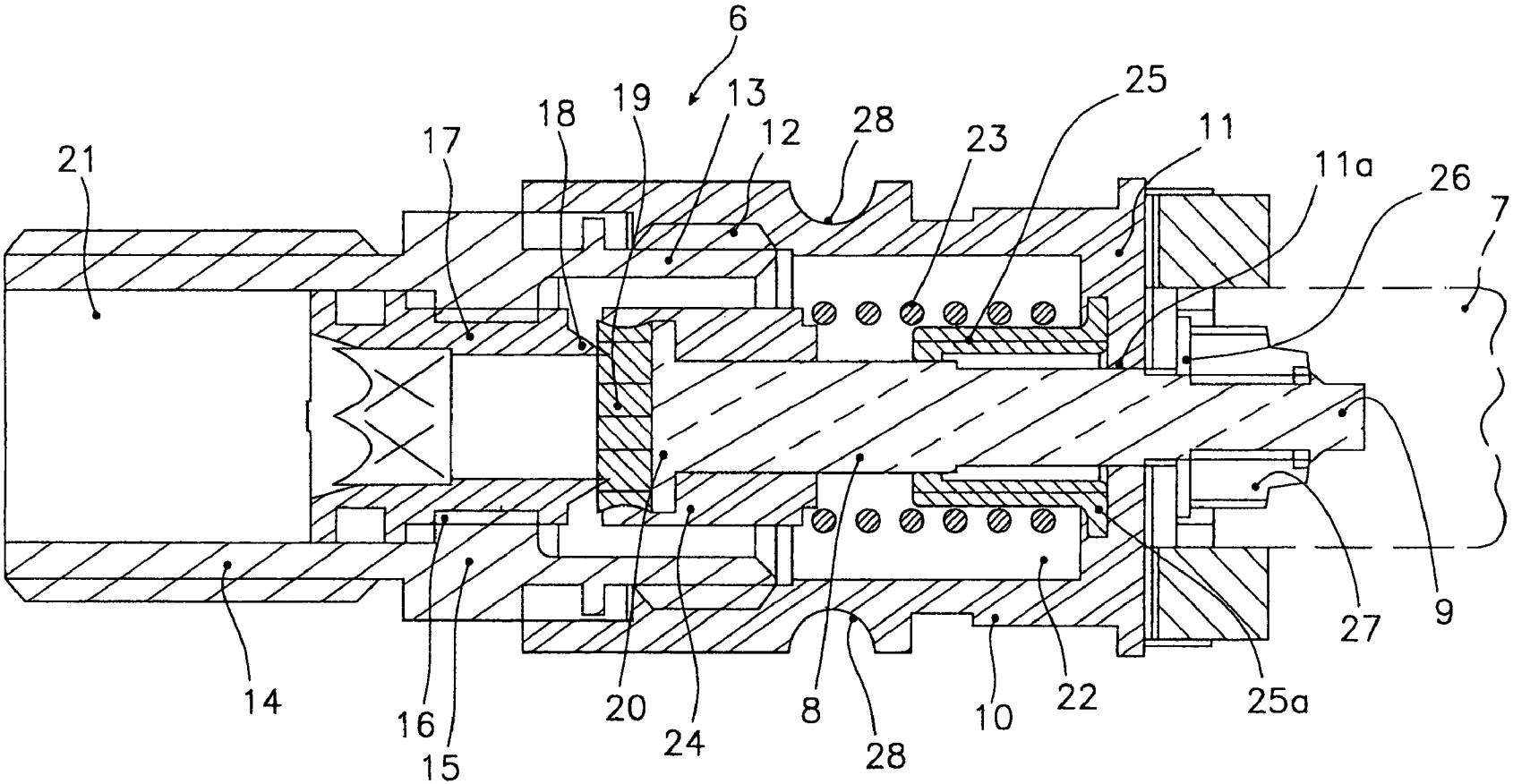
FIG. 4 is a sectional view taken along lines IV-IV of FIG. 3.

A regulator control group, shown in FIGS. 2, 3 and 4 and generically denoted by 6, is positioned inside the inlet conduit 2. The control group comprises a lever 7 which is in contact, in a known manner, with the aforesaid deformable diaphragm through its free end 7*a*, while with its other end 7*b* it is connected to the poppet of the regulator 8, and in particular to the end, or tail, 9 thereof, as shown in FIG. 3.

The control group 6 also comprises a first bushing 10 whose bottom 11 has a central hole 11*a* wherein the poppet 8 is engaged loosely. The first bushing 10 has internal threading 12 whereon an externally threaded end 13 of a second bushing 14 is screw engaged. Second bushing 14 in turn has an internal threaded portion 15 whereon a corresponding threaded portion 16 of a third bushing 17 is screw engaged. The end 18 of third bushing 17, turned towards the poppet 8, has an annular ribbing forming the regulator seat, on which a seal 19 of the head 20 of the poppet 8 is engaged.

The second bushing 14 defines an inlet chamber 21 wherein the third bushing 17 is engaged, while the first bushing 10 defines an intermediate chamber 22 communicating with the inlet chamber 21 through the regulator seat 18 cut off by the seal 19.

The seal 19 is kept forced against the regulator seat 18 by means of a coil spring 23 extending coaxially to the poppet 8 inside the intermediate chamber 22. In particular the spring 23 abuts on one side against a ring nut 24 which covers the head 20 of the poppet 8 and on the other side against a flange 25*a* of a tubular seal 25 connected tightly to the poppet 8 and to the bottom 11 of the first bushing 10 around the opening 11*a*.

The end 7*b* of the lever 7 is fork-shaped and engages on the tail 9 of the poppet 8 projecting from the hole 11*a* of the first bushing 10, between the bottom wall 11 and a washer 26. The washer 26 is tightened against the fork-shaped end 7*b* of the lever 7 by means of a nut 27 screwed to the tail 9 of the poppet 8.

The control group 6 is mounted as follows:

the tubular seal 25 is arranged at the bottom of the first bushing 10 and the spring 23 is rested on the flange 25*a;* the ring nut 24 is inserted on the poppet 8 and then the tail 9 of the poppet is inserted first in the spring 23, then in the first bushing 10 and finally in the hole 11*a* of the bottom 11 thereof;

the washer 26 is inserted on the threaded end of the tail 9 of the poppet 8 and then the nut 27 is screwed on;

the end 7*b* of the lever 7 is inserted between the washer 26 and bottom wall 11.

By adjusting the nut 27, the degree of tightness of the second bushing 14 inside the first bushing 10 and the degree of tightness of the third bushing 17 inside the second bushing, on the one hand it is possible to calibrate the force with which the seal 19 of the poppet 8 is pressed against the regulator seat 18 and, on the other hand, by adjusting the degree of tightness of the nut 27 it is possible to calibrate the exact position of the end 7*a* of the lever 7 intended to come into contact with the diaphragm, not shown, of the regulator.

Control group 6 is preferably calibrated using an appropriate mechanism before it is mounted in regulator body 1 via inlet conduit 2, as shown in FIG. 2. Two diametrically opposed slots or grooves 28 are formed in an external surface of a first bushing 10, generally perpendicular to a longitudinal axis of symmetry, and two holes 29 desirably located at the same general distance transversely as the grooves are preferably designed to hold two pins 30 when the grooves are in alignment with the holes. The relative longitudinal position of the elements of the second-stage regulator relative to the inlet conduit is, therefore, defined relatively precisely. Final attachment is accomplished using a nut 31 which engages external threading of second bushing 14 until the nut abuts one end of the inlet conduit.

Thanks to the structure of the control group for second-stage regulator according to the invention, the operation of calibration is simpler and more accurate in that it can be performed before mounting the group in the regulator body. It is also clear that by removing the entire group routine maintenance on the regulator is possible without having to dismount the group and therefore without having to calibrate it again, which would require assistance from a specialised technician.

Various modifications and alterations to the present invention may be appreciated based on a review of this disclosure. These changes and additions are intended to be within the scope and spirit of the invention as defined by the following claims.

What is claimed is:

1. A group for the controlling a second-stage regulator for scuba divers, the regulator comprising a regulator body with an inlet conduit for connecting to a first-stage regulator which supplies a breathable gaseous mixture at a relatively constant pressure, and an outlet conduit for connecting to a mouthpiece of the user, wherein the control group comprises: a first bushing defining an intermediate chamber with a bottom wall in which a central hole is formed; a poppet loosely engaged within the hole, an end of the poppet being connected to a lever; a second bushing engaged with the first bushing and defining an inlet chamber; a third bushing engaged in the second bushing and defining a regulator seat at one of its ends, a head of the poppet engaging tightly in the seat; and an elastic member in the intermediate chamber and coaxial to the poppet for maintaining the head against the regulator seat, the control group being removably engaged with the inlet conduit; the group further comprising an axial positioner between the first bushing and the regulator body, wherein the axial positioner comprises at least one slot formed along a circumference of the first bushing and a pair of holes formed in the inlet conduit of the regulator body and aligned circumferentially, the holes being placed relative to one another at a distance substantially equal to the length of the slot for engagement with corresponding screws adapted for cooperation with the slot so as to lock the position of the control group relative to the regulator body.

2. The control group set forth in claim 1, wherein the second bushing is threadably engaged in the first bushing and the third bushing is threadably engaged in the second bushing to allow regulation of their reciprocal position and, therefore, of the degree of compression of the elastic member.

3. The control group set forth in claim 1, wherein a plurality of diametrically opposed grooves are formed in the bushing.

4. The control group set forth in claim 1, wherein the lever has a fork-shaped end engaged with a tail of the poppet projecting from the central hole in the bottom of the first bushing, the fork-shaped end being tightened against the bottom by a nut screwed to the tail of the poppet with the insertion of a locking washer.

5. The control group set forth in claim 1, wherein the elastic member comprises a coil spring extending between the bottom and the head of the poppet.

6. The control group set forth in claim 5, wherein a tubular seal is provided, connected tightly to the bottom and to the poppet, a ring nut being further provided for covering the head of the poppet, the coil spring extending between the ring nut and the tubular seal.

7. A group for controlling a second-stage regulator for scuba divers, the regulator comprising a regulator body with an inlet conduit for connecting to a first-stage regulator which supplies a breathable gaseous mixture at a relatively constant pressure, and an outlet conduit for connecting to a mouthpiece of the user, wherein the control group comprises: a first bushing defining an intermediate chamber with a bottom wall in which a central hole is formed; a poppet loosely engaged within the hole, an end of the poppet being connected to a lever; a second bushing engaged with the first bushing and defining an inlet chamber; a third bushing engaged in the second bushing and defining a regulator seat at one of its ends, a head of the poppet engaging tightly in the seat; an elastic member in the intermediate chamber and coaxial to the poppet for maintaining the head against the regulator seat, the control group being removably engaged with the inlet conduit; and an axial positioner between the first bushing and the regulator body.

8. A group for controlling a second-stage regulator for scuba divers, the regulator comprising a regulator body with an inlet conduit for connecting to a first-stage regulator which supplies a breathable gaseous mixture at a relatively constant pressure, and an outlet conduit for connecting to a mouthpiece of the user, wherein the control group comprises: a first bushing defining an intermediate chamber with a bottom wall in which a central hole is formed; a poppet loosely engaged within the hole, an end of the poppet being connected to a lever; a second bushing engaged with the first bushing and defining an inlet chamber; a third bushing engaged in the second bushing and defining a regulator seat at one of its ends, a head of the poppet engaging tightly in the seat; an elastic member being provided in the intermediate chamber and coaxial to the poppet for maintaining the head against the regulator seat, the control group being removably engaged with the inlet conduit; and an axial positioner between the first bushing and the regulator body, the axial positioner having at least one slot formed along a circumference of the first bushing and a pair of holes formed in the inlet conduit of the regulator body and aligned circumferentially, the holes being placed relative to one another at a distance substantially equal to the length of the slot for engagement with corresponding screws adapted for cooperation with the slot so as to lock the position of the control group relative to the regulator body.

9. A group for the controlling a second-stage regulator for scuba divers, the regulator comprising a regulator body with an inlet conduit for connecting to a first-stage regulator which supplies a breathable gaseous mixture at a relatively constant pressure, and an outlet conduit for connecting to a mouthpiece of the user, wherein the control group comprises: a first bushing defining an intermediate chamber with a bottom wall in which a central hole is formed; a poppet loosely engaged within the hole, an end of the poppet being connected to a lever; a second bushing engaged with the first bushing and defining an inlet chamber; and a third bushing engaged in the second bushing and defining a regulator seat at one of its ends, a head of the poppet engaging tightly in the seat; an elastic member being provided in the intermediate chamber and coaxial to the poppet for maintaining the head against the regulator seat, the group being removably engaged with the inlet conduit, wherein a plurality of diametrically opposed grooves in the first bushing are formed.

* * * * *

UNITED STATES PATENT AND TRADEMARK OFFICE

CERTIFICATE OF CORRECTION

PATENT NO. : 7,347,206 B2
APPLICATION NO. : 10/899203
DATED : March 25, 2008
INVENTOR(S) : Stefano Pedemonte It is certified that error appears in the above-identified patent and that said Letters Patent is hereby corrected as shown below:

Title Page, item [57] Abstract, on line 9, replace “lever means” with -- a lever --;

in column 1, on line 11, delete “ART”;

in column 1, on line 16, replace “via” with -- from --;

in column 1, on line 20, replace “of the known type” with -- typically --;

in column 1, on line 21, replace “the outlet” with -- an outlet --;

in column 1, on line 23, replace “and” with -- . The outlet chamber is --;

in column 1, on line 26, delete “off”;

in column 1, on line 27, replace “The” with -- Through appropriate calibration of the first-stage regulator, the --;

in column 1, on lines 29-30, delete “thanks to appropriate claibration of the first-stage regulator”;

in column 1, on line 31, insert -- , -- after “outlet chamber”;

in column 1, on line 33, insert -- on the other hand, -- after “inhales,”;

in column 1, on line 34, replace “towards” with -- toward --;

in column 1, on line 34, replace “said” with -- the --;

in column 1, on line 37, replace “opening” with -- open or starting position --;

in column 1, on line 38, replace “The opening” with -- Opening --;

in column 1, on lines 38-39, delete “between the inlet chamber and outlet chamber”;

UNITED STATES PATENT AND TRADEMARK OFFICE

CERTIFICATE OF CORRECTION

PATENT NO. : 7,347,206 B2
APPLICATION NO. : 10/899203
DATED : March 25, 2008
INVENTOR(S) : Stefano Pedemonte It is certified that error appears in the above-identified patent and that said Letters Patent is hereby corrected as shown below:

in column 1, on line 39, replace “an overpressure” with -- excess pressure --;

in column 1, on line 40, replace “so” with -- such --;

in column 1, on line 40, replace “the rest” with -- a beginning or resting --;

in column 1, on line 41, replace “returning” with -- causing --;

in column 1, on line 41, replace “into the” with -- to return to its --;

in column 1, on line 42, replace “wherein” with -- where --;

in column 1, on line 44, replace “of the known type” with -- , --;

in column 1, on line 45, replace “on” with -- upon --;

in column 1, on line 46, delete “of the regulator”;

in column 1, on line 47, replace “to” with -- with --;

in column 1, on line 47, insert -- regulator -- before “body”;

in column 1, on line 47, delete “of the same regulator”;

in column 1, on line 47, replace “This” with -- While useful, this --;

in column 1, on line 48, delete “the”;

in column 1, on line 48, insert -- that are -- after “operations”;

in column 1, on line 49, replace “the unavoidable” with -- for --;

in column 1, on line 50, insert -- of the various components from their optimum values as occur during manufacture -- after “deviations”;

UNITED STATES PATENT AND TRADEMARK OFFICE

CERTIFICATE OF CORRECTION

PATENT NO. : 7,347,206 B2
APPLICATION NO. : 10/899203
DATED : March 25, 2008
INVENTOR(S) : Stefano Pedemonte It is certified that error appears in the above-identified patent and that said Letters Patent is hereby corrected as shown below:

in column 1, on line 50, replace “within the” with -- to within appropriate --;

in column 1, on lines 50-51, delete “, of the various components from the optimum values”;

in column 1, on line 51, insert -- , relatively -- after “Moreover”;

in column 1, on line 52, insert -- otherwise -- after “could”;

in column 1, on line 53, delete “without problems even”;

in column 1, on lines 53-54, replace “instead requires intervention by a specialised” with -- must be done by a skilled --;

in column 1, on lines 54-55, replace “in that the device has to be recalibrated each time” with -- or other with expertise in scuba diving equipment each time recalibration is necessary --;

in column 1, on line 62, replace “with” with -- , the group having --;

in column 1, on line 62, insert -- that not only -- after “structure”;

in column 1, on line 63, replace “and which” with -- , but also --;

in column 1, on line 64, insert -- the -- before “necessity”;

in column 1, on line 65, replace “the” with -- a --;

in column 1, on line 66, replace “This object is achieved with the group” with -- According to one aspect of the present invention, a group is provided --;

from column 1, on line 67 through column 2, line 1, replace “diver according to the present invention whose feature consists in that it comprises” with -- divers. The regulator includes a regulator body with an inlet conduit for connection to a first-stage regulator which supplies a breathable gaseous mixture at a constant pressure, and an outlet conduit for connection to a mouthpiece of the user. The control group includes: --;

UNITED STATES PATENT AND TRADEMARK OFFICE

CERTIFICATE OF CORRECTION

PATENT NO. : 7,347,206 B2
APPLICATION NO. : 10/899203
DATED : March 25, 2008
INVENTOR(S) : Stefano Pedemonte It is certified that error appears in the above-identified patent and that said Letters Patent is hereby corrected as shown below:

in column 2, line 2, replace “with” with -- having --;

in column 2, on line 3, replace “wall wherein” with -- wall in which --;

in column 2, on line 3, replace “formed wherein” with -- formed; --;

in column 2, on line 4, delete “engages”;

in column 2, on line 4, insert -- engaged with the hole -- after “loosely”;

in column 2, on line 5, replace “lever means,” with -- a lever; --;

in column 2, on line 7, replace “on which the” with -- a --;

in column 2, on line 7, replace “engages” with -- engaging --;

in column 2, on line 7, replace “,” with -- in the seat. An --;

in column 2, on line 8, replace “means being” with -- member is --;

in column 2, on line 8, delete “coaxial to the poppet”;

in column 2, on line 9, insert -- and coaxial to the poppet -- after “chamber”;

in column 2, on line 10, replace “whole” with -- control --;

in column 2, on line 10, replace “in” with -- with --;

in column 2, on line 12, insert the following new paragraphs:

-- In accordance with another aspect of the present invention, a group is provided for the control of a second-stage regulator for scuba divers, the regulator comprising a regulator body with an inlet conduit for connection to a first-stage regulator which supplies a breathable gaseous mixture at a relatively constant pressure, and an outlet conduit for connection to a mouthpiece of the user. The control group includes: a first bushing defining an intermediate chamber with a bottom wall in which It is certified that error appears in the above-identified patent and that said Letters Patent is hereby corrected as shown below:

a central hole is formed; a poppet loosely engaged within the hole, an end of the poppet being connected to a lever; a second bushing engaged with the first bushing and defining an inlet chamber; a third bushing engaged in the second bushing and defining a regulator seat at one of its ends, a head of the poppet engaging tightly in the seat; and an elastic member in the intermediate chamber and coaxial to the poppet for maintaining the head against the regulator seat, the control group being removably engaged with the inlet conduit. The group further comprises an axial positioner between the first bushing and the regulator body, wherein the axial positioner comprises at least one slot formed along a circumference of the first bushing and a pair of holes formed in the inlet conduit of the regulator body and aligned circumferentially, the holes being placed relative to one another at a distance substantially equal to the length of the slot for engagement with corresponding screws adapted for cooperation with the slot so as to lock the position of the control group relative to the regulator body.

According to a further aspect of the present invention is a group for the control of a second-stage regulator for scuba divers, wherein the regulator comprises a regulator body with an inlet conduit for connection to a first-stage regulator which supplies a breathable gaseous mixture at a relatively constant pressure, and an outlet conduit for connection to a mouthpiece of the user. The control group includes: a first bushing defining an intermediate chamber with a bottom wall in which a central hole is formed; a poppet loosely engaged within the hole, an end of the poppet being connected to a lever; a second bushing engaged with the first bushing and defining an inlet chamber; a third bushing engaged in the second bushing and defining a regulator seat at one of its ends, a head of the poppet engaging tightly in the seat; an elastic member in the intermediate chamber and coaxial to the poppet for maintaining the head against the regulator seat, the control group being removably engaged with the inlet conduit; and an axial positioner between the first bushing and the regulator body.

In accordance with yet another aspect of the present invention; there is provided a control group of a second-stage regulator for scuba divers. The regulator comprises a regulator body with an inlet conduit for connection to a first-stage regulator which supplies a breathable gaseous mixture at a relatively constant pressure, and an outlet conduit for connection to a mouthpiece of the user. The control group includes: a first bushing defining an intermediate chamber with a bottom wall in which a central hole is formed; a poppet loosely engaged within the hole, an end of the poppet being connected to a lever; a second bushing engaged with the first bushing and defining an inlet chamber; a third bushing engaged in the second bushing and defining a regulator seat at It is certified that error appears in the above-identified patent and that said Letters Patent is hereby corrected as shown below:

one of its ends, a head of the poppet engaging tightly in the seat; an elastic member being provided in the intermediate chamber and coaxial to the poppet for maintaining the head against the regulator seat, the control group being removably engaged with the inlet conduit; and an axial positioner between the first bushing and the regulator body, the axial positioner having at least one slot formed along a circumference of the first bushing and a pair of holes formed in the inlet conduit of the regulator body and aligned circumferentially, the holes being placed relative to one another at a distance substantially equal to the length of the slot for engagement with corresponding screws adapted for cooperation with the slot so as to lock the position of the control group relative to the regulator body.

According to still another aspect of the present invention, a group is provided for the control of a second-stage regulator for scuba divers. The regulator comprises a regulator body with an inlet conduit for connection to a first-stage regulator which supplies a breathable gaseous mixture at a relatively constant pressure, and an outlet conduit for connection to a mouthpiece of the user. The control group includes: a first bushing defining an intermediate chamber with a bottom wall in which a central hole is formed; a poppet loosely engaged within the hole, an end of the poppet being connected to a lever; a second bushing engaged with the first bushing and defining an inlet chamber; and a third bushing engaged in the second bushing and defining an inlet chamber; and a third bushing engaged in the second bushing and defining a regulator seat at one of its ends, a head of the poppet engaging tightly in the seat; an elastic member being provided in the intermediate chamber and coaxial to the poppet for maintaining the head against the regulator seat, the group being removably engaged with the inlet conduit, wherein a plurality of diametrically opposed grooves in the first bushing are formed. --;

in column 2, on line 25, insert -- and -- after “;”;

in column 2, on line 40, insert -- 6 -- after “group”;

in column 2, on line 44, replace “is used for connecting” with -- connects --;

in column 2, on line 47, insert -- scuba diver’s -- before “mouth”;

in column 2, on lines 47-48, delete “the scuba diver via”;

CERTIFICATE OF CORRECTION

PATENT NO. : 7,347,206 B2
APPLICATION NO. : 10/899203
DATED : March 25, 2008
INVENTOR(S) : Stefano Pedemonte It is certified that error appears in the above-identified patent and that said Letters Patent is hereby corrected as shown below:

in column 2, after line 48, insert the following paragraph:

-- The regulator also comprises a front frame 4 attached to regulator body 1; e.g., in a conventional manner, so as to lock the internal diaphragm (not shown) against an edge of a corresponding opening (also not shown) of the regulator body, and to hold a control pushbutton 5 centrally. The foregoing description is provided for purposes of illustration and not to limit the intended environment or application of the present invention. The remaining structural and functional aspects of second-stage regulators are known by those skilled in the art and further description is considered necessary for illustration of the present invention. --;

in column 2, on line 49, replace “A” with -- As shown in FIGS. 2-4, --;

in column 2, on lines 49-50, replace “, shown in FIGS. 2, 3 and 4 and generically denoted by 6,” with -- 6 --;

in column 2, on line 50, insert -- generally -- after “positioned”;

in column 2, on line 50, delete “the”;

in column 2, on line 51, insert -- preferably -- after “group”;

in column 2, on line 52, insert -- e.g., -- after “contact,”;

in column 2, on line 52, replace “known” with -- conventional --;

in column 2, on line 52, delete “aforesaid”;

in column 2, on line 53, replace “through its” with -- at a --;

in column 2, on line 53, replace “with its other” with -- another --;

in column 2, on line 54, replace “it” with -- of the lever --;

in column 2, on line 54, replace “the poppet” with -- a poppet 8 --;

UNITED STATES PATENT AND TRADEMARK OFFICE

CERTIFICATE OF CORRECTION

PATENT NO. : 7,347,206 B2
APPLICATION NO. : 10/899203
DATED : March 25, 2008
INVENTOR(S) : Stefano Pedemonte It is certified that error appears in the above-identified patent and that said Letters Patent is hereby corrected as shown below:

in column 2, on line 54, replace “8, and” with -- and, --;

in column 2, on line 55, insert -- , -- after “particular”;

in column 2, on line 55, replace “the” with -- an --;

in column 2, on line 55, replace “, or tail,” with -- or tail --;

in column 2, on line 56, replace “6 also” with -- additionally --;

in column 2, on line 57, replace “whose” with -- , a --;

in column 2, on line 57, insert -- portion -- after “bottom”;

in column 2, on line 57, insert -- of the bushing having -- after “11”;

in column 2, on line 57, delete “has”;

in column 2, on line 57, replace “wherein the” with -- in which --;

in column 2, on line 58, delete “engaged”;

in column 2, on line 58, insert “engaged” after -- loosely --;

in column 2, on line 58, delete “10”;

in column 2, on line 58, insert -- an -- after “has”;

in column 2, on line 59, replace “threading” with -- threaded portion --;

in column 2, on line 59, replace “whereon” with -- with which --;

in column 2, on line 60, replace “screw” with -- threadably --;

in column 2, on lines 60-61, replace “in turn” with -- , in turn, --;

UNITED STATES PATENT AND TRADEMARK OFFICE

CERTIFICATE OF CORRECTION

PATENT NO. : 7,347,206 B2
APPLICATION NO. : 10/899203
DATED : March 25, 2008
INVENTOR(S) : Stefano Pedemonte It is certified that error appears in the above-identified patent and that said Letters Patent is hereby corrected as shown below:

in column 2, on line 61, replace “whereon” with -- with --;

in column 2, on line 62, replace “is screw” with -- threadably --;

in column 2, on line 63, insert -- therewith -- after “engaged”;

in column 2, on line 63, replace “The end 18” with -- An end --;

in column 2, on line 64, delete “8”;

in column 2, on line 64, replace “has an” with -- includes --;

in column 2, on line 64, replace “forming the” with -- that forms a --;

in column 2, on line 64, insert -- 18 -- after “seat”;

in column 2, on line 65, replace “the head” with -- a head --;

in column 2, on line 65, delete “8”;

in column 2, on line 66, replace “The” with -- Furthermore, the --;

in column 2, on line 66, delete “14”;

in column 2, on line 67, replace “wherein” with -- in which --;

in column 2, on line 67, delete “17”;

in column 3, on line 1 , delete “10”;

in column 3, on lines 1-2, replace “communicating” with -- in communication --;

in column 3, on line 2, replace “the inlet chamber” with -- inlet chamber --;

UNITED STATES PATENT AND TRADEMARK OFFICE

CERTIFICATE OF CORRECTION

PATENT NO. : 7,347,206 B2
APPLICATION NO. : 10/899203
DATED : March 25, 2008
INVENTOR(S) : Stefano Pedemonte It is certified that error appears in the above-identified patent and that said Letters Patent is hereby corrected as shown below:

in column 3, on line 2, delete “the” after “through”;

in column 3, on line 3, replace “cut off by the” with -- , such being closed by --;

in column 3, on line 4, replace “The” with -- Preferably, --;

in column 3, on line 4, replace “kept forced against the” with -- biased against --;

in column 3, on line 5, delete “means of”;

in column 3, on line 5, replace “extending” with -- that extends --;

in column 3, on line 5, insert -- relative -- after “coaxially”;

in column 3, on line 6, replace “8 inside the” with -- and inside --;

in column 3, on line 6, replace “In particular the” with -- Specifically, --;

in column 3, on line 7, replace “abuts” with -- , --;

in column 3, on line 7, replace “against” with -- , abuts --;

in column 3, on line 7, delete “the”;

in column 3, on line 8, delete “8”;

in column 3, on line 8, insert -- , -- after “and”;

in column 3, on line 8, replace “against” with -- , abuts --;

in column 3, on line 9, insert -- both -- after “tightly”;

UNITED STATES PATENT AND TRADEMARK OFFICE

CERTIFICATE OF CORRECTION

PATENT NO. : 7,347,206 B2
APPLICATION NO. : 10/899203
DATED : March 25, 2008
INVENTOR(S) : Stefano Pedemonte It is certified that error appears in the above-identified patent and that said Letters Patent is hereby corrected as shown below:

in column 3, on line 9, delete “8”;

in column 3, on line 10, replace “11” with -- portion --;

in column 3, on line 10, delete “10”;

in column 3, on line 10, delete “the” after “around”;

in column 3, on line 12, replace “The end” with -- End --;

in column 3, on line 12, delete “the” before “lever”;

in column 3, on line 13, delete “the” before “tail”;

in column 3, on line 13, delete “the” before “poppet”;

in column 3, on line 13, insert -- , -- after “8”;

in column 3, on line 13, delete “the” before “hole”;

in column 3, on lines 13-14, delete “the” before “first”;

in column 3, on line 14, delete “the” before “bottom”;

in column 3, on line 14, insert -- portion or -- after “bottom”;

in column 3, on line 15, replace “The washer 26” with -- The washer --;

in column 3, on line 15, replace “the fork-shaped” with -- fork-shaped --;

in column 3, on line 16, replace “by means of” with -- using --;

UNITED STATES PATENT AND TRADEMARK OFFICE

CERTIFICATE OF CORRECTION

PATENT NO. : 7,347,206 B2
APPLICATION NO. : 10/899203
DATED : March 25, 2008
INVENTOR(S) : Stefano Pedemonte It is certified that error appears in the above-identified patent and that said Letters Patent is hereby corrected as shown below:

in column 3, on line 16, insert -- engaged with, e.g., -- before "screwed";

in column 3, on line 16, replace "to the tail 9" with -- onto, the tail --;

in column 3, on line 17, delete "8";

in column 3, on line 18, replace "The" with -- According to one aspect of the present invention, the --;

in column 3, on line 18, delete "6";

in column 3, on line 18, insert -- to the second-stage regulator, -- before "as";

in column 3, on line 18, after "follows:" insert -- First, tubular seal 25 is arranged at bottom portion or wall 11 of first bushing 10, and spring 23 is placed on flange 25a. Next, ring nut 24 is inserted on poppet 8. Tail 9 of the poppet is then inserted in the spring, in the first bushing, and, finally, in hole 11a of the bottom wall. Thereafter, washer 26 is inserted on the threaded end of the tail, and nut 27 is screwed on. Last, end 7b of lever 7 is inserted between the washer and bottom wall. --;

in column 3, on line 19, delete "the tubular seal 25 is arranged at the bottom of the first";

in column 3, on line 20, delete "bushing 10 and the spring 23 is rested on the flange";

in column 3, on line 21, delete "25a;";

in column 3, on line 22, delete "the ring nut 24 is inserted on the poppet 8 and then the tail";

in column 3, on line 23, delete "9 of the poppet is inserted first in the spring 23, then in";

UNITED STATES PATENT AND TRADEMARK OFFICE

CERTIFICATE OF CORRECTION

PATENT NO. : 7,347,206 B2
APPLICATION NO. : 10/899203
DATED : March 25, 2008
INVENTOR(S) : Stefano Pedemonte It is certified that error appears in the above-identified patent and that said Letters Patent is hereby corrected as shown below:

in column 3, on line 24, delete "the first bushing 10 and finally in the hole 11a of the";

in column 3, on line 25, delete "bottom 11 thereof;";

in column 3, on line 26, delete "the washer 26 is inserted on the threaded end of the tail 9";

in column 3, on line 27, delete "of the poppet 8 and then the nut 27 is screwed on;";

in column 3, on line 28, delete "the end 7b of the lever 7 is inserted between the washer";

in column 3, on line 29, delete "26 and bottom wall 11.";

in column 3, on line 30, replace "the nut 27" with -- nut 27 --;

in column 3, on line 31, delete "14";

in column 3, on line 31, delete "10";

in column 3, on lines 32-33, delete "the degree of tightness";

in column 3, on line 33, delete "17";

in column 3, on line 35, replace "the seal 19" with -- seal 19 --;

in column 3, on line 35, delete "8";

in column 3, on lines 35-36, replace "the regulator seat 18 and, on" with -- regulator seat 18. On --;

in column 3, on line 37, replace "the nut 27 it is" with -- nut 27, it is also --;

UNITED STATES PATENT AND TRADEMARK OFFICE

CERTIFICATE OF CORRECTION

PATENT NO. : 7,347,206 B2
APPLICATION NO. : 10/899203
DATED : March 25, 2008
INVENTOR(S) : Stefano Pedemonte It is certified that error appears in the above-identified patent and that said Letters Patent is hereby corrected as shown below:

in column 3, on line 38, replace “the end 7a” with -- end 7a --;

in column 3, on line 38, replace “7 intended” with -- that is desired --;

in column 3, on line 39, delete “, not shown,”;

in column 3, on line 42, replace “Two” with -- For instance, two --;

in column 3, on line 43, delete “are”;

in column 3, on line 45, delete “desirably”;

in column 3, on line 47, insert -- , -- after “grooves”;

in column 3, on line 47, replace “preferably designed” with -- desirably provided --;

in column 3, on line 48, replace “in alignment” with -- aligned --;

in column 3, on line 54, replace “Thanks to” with -- Overall, --;

in column 3, on lines 55-56, replace “the operation of calibration is” with -- advantageously provides for calibration operations that are considerably --;

in column 3, on line 57, insert -- control -- before “group”;

in column 3, on line 58, replace “It is also clear that by removing” with -- Moreover, since --;

in column 3, on line 58, insert -- is easily removed, -- after “group”;

in column 3, on line 59, insert -- now -- after “is”;

UNITED STATES PATENT AND TRADEMARK OFFICE

CERTIFICATE OF CORRECTION

PATENT NO. : 7,347,206 B2
APPLICATION NO. : 10/899203
DATED : March 25, 2008
INVENTOR(S) : Stefano Pedemonte It is certified that error appears in the above-identified patent and that said Letters Patent is hereby corrected as shown below:

in column 3, on line 60, replace "dismount" with -- dissemble --;

in column 3, on line 60, replace "and therefore without having to calibrate it again, which would require assistance from a specialised technician" with -- itself, which would necessitate its recalibration and, in turn, the assistance of a skilled technician or other with expertise in scuba diving equipment --;

in column 4, on line 2, delete "the";

in column 6, on line 4, delete "the";

Signed and Sealed this

Fifteenth Day of December, 2009

David J. Kappos

David J. Kappos
*Director of the United States Patent and Trademark Office*